US009520011B2

(12) United States Patent
Luo et al.

(10) Patent No.: US 9,520,011 B2
(45) Date of Patent: Dec. 13, 2016

(54) METHOD AND DEVICE FOR DETECTING AND CONTROLLING SELF-SERVICE TERMINAL CASH DISPENSING QUALITY

(71) Applicant: GRG Banking Equipment Co., Ltd., Guangzhou, Guangdong (CN)

(72) Inventors: Panfeng Luo, Guangzhou (CN); Dahai Xiao, Guangzhou (CN); Weiping Xie, Guangzhou (CN); Xuewen Dong, Guangzhou (CN); Qinghua Wang, Guangzhou (CN); Hongshuai Zhang, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/432,735

(22) PCT Filed: Jul. 9, 2013

(86) PCT No.: PCT/CN2013/079058
§ 371 (c)(1),
(2) Date: Mar. 31, 2015

(87) PCT Pub. No.: WO2014/114061
PCT Pub. Date: Jul. 31, 2014

(65) Prior Publication Data

US 2015/0254921 A1 Sep. 10, 2015

(30) Foreign Application Priority Data

Jan. 22, 2013 (CN) ..... 2013 1 0024038

(51) Int. Cl.
*G07D 11/00* (2006.01)

(52) U.S. Cl.
CPC ..... *G07D 11/0039* (2013.01); *G07D 11/0045* (2013.01); *G07D 11/0048* (2013.01); *G07D 11/0051* (2013.01); *G07D 11/0054* (2013.01)

(58) Field of Classification Search
CPC ..... G07D 11/0039; G07D 11/0045; G07D 11/0051; G07F 19/20; G07F 19/203; G06Q 20/1085
(Continued)

(56) References Cited

U.S. PATENT DOCUMENTS 4,524,268 A * 6/1985 Fukatsu ..... G07F 19/20 209/534
4,529,119 A * 7/1985 Granzow ..... E05G 5/006 109/43
(Continued)

FOREIGN PATENT DOCUMENTS

CN 1612173 A 5/2005
CN 102637319 A 8/2012
(Continued)

OTHER PUBLICATIONS

Extended European Search Report, dated Dec. 18, 2015, from a corresponding European Patent Application No. 13872658.3.
(Continued)

*Primary Examiner* — Suezu Ellis
(74) *Attorney, Agent, or Firm* — Wolf, Greenfield & Sacks, P.C.

(57) ABSTRACT

A method and a device for detecting and controlling banknote dispensing quality in a self-service terminal are provided. The method includes: detecting an empty box in the self-service terminal, setting a qualified rate of dispensed banknotes of the empty box as 0, and permanently shielding the empty box; detecting a banknote jammed cashbox in the self-service terminal, setting a qualified rate of dispensed banknotes of the banknote-jammed cashbox as 0, and permanently shielding the banknote-jammed cashbox; detect-
(Continued)

ing qualified rates of dispensed banknotes of all non-empty cashboxes and non-banknote-jammed cashboxes, classifying all the non-empty and non-banknote-jammed cashboxes according to nominal values, and sequencing the cashboxes per nominal value in a descending order of the qualified rates of dispensed banknotes; and maintaining cashboxes ranked top M of the qualified rates of dispensed banknotes per nominal value in an open state, and maintaining the other cashboxes in a temporarily shielded state.

18 Claims, 4 Drawing Sheets

(58) Field of Classification Search
USPC ..... 235/379; 705/43; 194/206
See application file for complete search history.

(56) References Cited

U.S. PATENT DOCUMENTS

| | | | | |
|---|---|---|---|---|
| 4,871,085 | A | 10/1989 | Graef et al. | |
| 5,561,281 | A * | 10/1996 | Eda | G07D 11/0006 235/379 |
| 6,378,770 | B1 | 4/2002 | Clark et al. | |
| 8,225,988 | B1 | 7/2012 | Bohen et al. | |
| 2005/0199701 | A1 * | 9/2005 | Tsuchiya | G07F 19/209 235/379 |
| 2009/0166269 | A1 * | 7/2009 | Tanaka | G07D 11/0072 209/534 |
| 2013/0041809 | A1 * | 2/2013 | Ino | G07C 9/00166 705/39 |

FOREIGN PATENT DOCUMENTS

| | | | |
|---|---|---|---|
| CN | 103136852 | A | 6/2013 |
| JP | H04205292 | A | 7/1992 |
| JP | 0581507 | A | 4/1993 |
| JP | 2011076416 | A | 4/2011 |

OTHER PUBLICATIONS

Written Opinion of the International Searching Authority, dated Oct. 31, 2013, from corresponding International Application No. PCT/CN2013/079058.

International Search Report dated Oct. 31, 2013 from corresponding International Application No. PCT/CN2013/079058.

* cited by examiner

METHOD AND DEVICE FOR DETECTING AND CONTROLLING SELF-SERVICE TERMINAL CASH DISPENSING QUALITY

The present application is the national phase of International Application No. PCT/CN2013/079058, filed on Jul. 16, 2013, which claims priority to Chinese Patent Application No. 201310024038.8, entitled "METHOD AND DEVICE FOR DETECTING AND CONTROLLING SELF-SERVICE TERMINAL CASH DISPENSING QUALITY", filed with the Chinese Patent Office on Jan. 22, 2013, which applications are hereby incorporated by reference to the maximum extent allowable by law.

TECHNICAL FIELD

The present application relates to the field of financial equipment, and particularly to a method and a device for detecting and controlling banknote dispensing quality in a self-service terminal.

BACKGROUND

Along with development and progress of technology, in some situations where a large amount of cash are to be handled, conventional processes such as manual counting, sorting and bundling are gradually taken over by a variety of advanced automatic handling systems. A machine core is one of core equipment in these systems.

There are two ways for the machine core of a self-service terminal to physically dispense banknotes, which are: dispensing banknotes according to slot, and dispensing banknotes according to nominal value.

Dispensing banknotes according to slot indicates dispensing banknotes according to the number of banknotes to be dispensed from respective slots, for example dispensing two banknotes from a first slot, and dispensing one banknote from a second slot. The dispensing banknotes according to nominal value indicates dispensing banknotes according to the number of banknotes at respective nominal values, for example dispensing two banknotes with nominal value of 100 yuan, and dispensing one banknote with nominal value of 50 yuan. The methods both have advantages and disadvantages. The method of dispensing banknotes according to slot has an advantage that: it can be ensured that cashboxes associated with a same nominal value dispense banknotes synchronously. For example, two cashboxes having banknotes at a nominal value of 100 can dispense banknotes simultaneously. However, the method of dispensing banknotes according to slot has a disadvantage that: in a case of multiple cashboxes associated with a same nominal value where a cashbox is empty and other cashboxes are non-empty, the non-empty cashboxes do not dispense banknotes if the empty cashbox fails to dispense banknotes. The method of dispensing banknotes according to nominal value has an advantage that: a cashbox dispenses banknotes only after another cashbox dispenses banknotes till empty, so the problem in the method of dispensing banknotes according to slot that failing to dispense in one cashbox will affect dispensing from other cashboxes, is avoided. However, by the method of dispensing banknotes according to nominal value, a cashbox dispenses banknotes only after another cashbox dispenses banknotes till empty, thus causing different lifetimes of the two cashboxes. The advantage of the method of dispensing banknotes according to nominal value corresponds to the disadvantage of the method of dispensing banknotes according to slot, and the disadvantage of the method of dispensing banknotes according to nominal value corresponds to the advantage of the method of dispensing banknotes according to slot.

In addition, for the cashbox, there is a consideration of banknote dispensing quality. The banknote dispensing quality of the cashbox relates to invalid banknotes dispensed from the cashbox. The more invalid banknotes are, the lower banknote dispensing quality of the cashbox is. The invalid banknotes will be recycled into a recycle box. If the banknote dispensing quality of the cashbox is too low, the recycle box is prone to be filled up with too many invalid banknotes, causing the self-service terminal unable to work properly. Therefore, once the recycle box is filled up with too many refused banknotes or unqualified banknotes from a cashbox with a high priority of dispensing, subsequent cashboxes with lower priorities of dispensing can not be used even though they are good in banknote quality. Especially, after banknotes are added into the self-service terminal, a too low qualified rate of banknotes dispensed from a cashbox for dispensing first will fill up the recycle box and cause the self-service terminal out of service. Then, other cashboxes can not be used even if qualified rates of banknotes in the cashboxes are very high, unless banknote clearance is performed by maintenance personnel, thus causing idling of self-service equipment resources and banknote resources. Low dispensing quality also causes excess mechanical abrasion of the machine core, and affects service quality and an operation rate of the self-service equipment.

Therefore, a method and a device for detecting banknote dispensing quality of cashboxes participating in a dispensing action during a dispensing process of the self-service terminal have significance in practice and value in usage.

SUMMARY

In view of the disadvantages and shortcomings in existing technology, the disclosure aims to provide a method for detecting and controlling banknote dispensing quality of a self-service terminal.

The application is implemented with technical solutions as follows. A method for detecting and controlling banknote dispensing quality of a self-service terminal, includes:

Step S1: detecting an empty box in the self-service terminal, setting a qualified rate of dispensed banknotes of the empty box as 0, and permanently shielding the empty box.

Step S2: detecting a banknote-jammed cashbox in the self-service terminal, setting a qualified rate of dispensed banknotes of the banknote-jammed cashbox as 0, and permanently shielding the banknote-jammed cashbox.

Step S3: detecting qualified rates of dispensed banknotes of all non-empty cashboxes and non-banknote-jammed cashboxes, classifying all the non-empty and non-banknote-jammed cashboxes according to nominal values, and sequencing the cashboxes per nominal value in a descending order of the qualified rates of dispensed banknotes.

Step S4: maintaining cashboxes ranked top M of the qualified rates of dispensed banknotes per nominal value in an open state, and maintaining the other cashboxes in a temporarily shielded state.

Furthermore, the qualified rate of dispensed banknotes is an average qualified rate of dispensed banknotes, i.e., a percentage of the number of qualified dispensed banknotes to the total number of dispensed banknotes, after starting of a banknote dispensing cycle; or, the qualified rate of dispensed banknotes is an instant qualified rate of dispensed banknotes, i.e., a percentage for a predetermined number of dispensed banknotes as the number of qualified dispensed banknotes to the predetermined number of dispensed banknotes.

A device for detecting and controlling banknote dispensing quality of a self-service terminal is further provided in the disclosure. The device includes an empty box detection module, a banknote jam detection module, a cashbox qualified rate detection module, a cashbox state control module, and a storage module. The empty box detection module detects an empty box in the self-service terminal, sets a qualified rate of dispensed banknotes of the empty box as 0, and permanently shields the empty box. The banknote jam detection module detects a banknote-jammed cashbox in the self-service terminal, sets a qualified rate of dispensed banknotes of the banknote-jammed cashbox as 0, and permanently shields the banknote-jammed cashbox. The cashbox qualified rate detection module detects qualified rates of dispensed banknotes of all non-empty cashboxes and non-banknote-jammed cashboxes, and sequences all the non-empty cashboxes and non-banknote-jammed cashboxes. The cashbox state control module maintains cashboxes ranked top M of the qualified rates of dispensed banknotes in an open state, and maintains the other cashboxes in a temporarily shielded state. And the storage module stores the detected qualified rates of dispensed banknotes and the set parameters, for all the modules to call.

As compared to the condition in existing technology, according to the method and the device for detecting and controlling banknote dispensing quality of a self-service terminal in this application, banknotes are dispensed first from a cashbox having a high qualified rate of dispensed banknotes, and the qualified rates of dispensed banknotes are re-sequenced every time after banknote dispensing. Thus, banknotes in the recycle box are as few as possible for a same amount of services. Banknote resources are optimized to reduce idling, and an operation rate of the self-service equipment.

For better understanding of the application, embodiments of the application are described in conjunction with drawings.

DETAILED DESCRIPTION OF THE EMBODIMENTS

Figure 1:
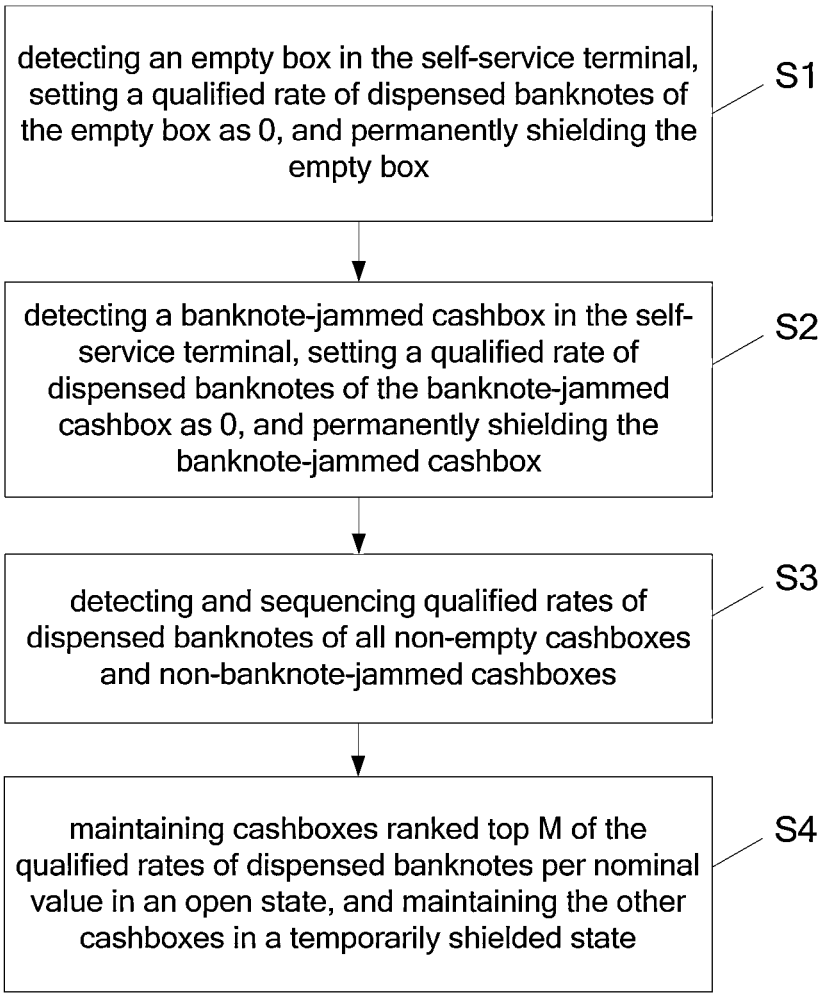
FIG. 1 is a flow chart of a method for detecting and controlling banknote dispensing quality of a self-service terminal according to the disclosure.

FIG. 1 is a flow chart of a method for detecting and controlling banknote dispensing quality of a self-service terminal according to the disclosure. The method for dispensing banknotes from a self-service terminal according to the disclosure includes steps S1 to S4.

Step S1 includes: detecting an empty box in the self-service terminal, setting a qualified rate of dispensed banknotes of the empty box as 0, and permanently shielding the empty box.

Banknote dispensing quality of the self-service terminal is evaluated with a qualified rate of dispensed banknotes, where the qualified rate of dispensed banknotes is a percentage of qualified banknotes to all banknotes dispensed from a cashbox after the banknotes being checked by a machine core. The self-service terminal detects whether a cashbox is empty with a mechanical device or a sensor arranged in the cashbox. The permanently shielding indicates that the self-service terminal can not change the cashbox from the shielded state back into an operational state in the banknotes-adding cycle, unless maintenance personnel intervene. Therefore, a cashbox permanently shielded after one round of banknote dispensing needs not to be detected and processed in next round of banknote dispensing. After banknotes are put into the empty box, the shielded state can be modified into an open state, and the cashbox is recovered to an operational state.

Step S2 includes: detecting a banknote-jammed cashbox in the self-service terminal, setting a qualified rate of dispensed banknotes of the banknote-jammed cashbox as 0, and permanently shielding the banknote-jammed cashbox.

In general, there are two ways for the machine core of a self-service terminal to physically dispense banknotes, which are: dispensing banknotes according to slot, and dispensing banknotes according to nominal value. Because of this feature, it is needed to detect banknote-jammed cashboxes for the mode of dispensing banknotes according to slot and the mode of dispensing banknotes according to nominal value, separately. Detection methods are described below in detail.

Step S3 includes: detecting qualified rates of dispensed banknotes of all non-empty cashboxes and non-banknote-jammed cashboxes, classifying all the non-empty and non-banknote-jammed cashboxes according to nominal values, and sequencing the cashboxes per nominal value in a descending order of the qualified rates of dispensed banknotes. Cashboxes not participating in this round of banknote dispensing, including cashboxes in a temporarily shielded state, should also participate in the sequencing.

The qualified rate of dispensed banknotes is a percentage of qualified banknotes to all banknotes dispensed from a cashbox after the banknotes being checked by a machine core. The qualified rate of dispensed banknotes includes two indexes, i.e., average qualified rate of dispensed banknotes, and instant qualified rate of dispensed banknotes. The average qualified rate of dispensed banknotes is evaluated with a percentage of the number of qualified dispensed banknotes to the total number of dispensed banknotes, after starting of a banknote dispensing cycle. The average qualified rate of dispensed banknotes is for evaluating, in a period or for a rated number of banknotes, a percentage of the number of qualified dispensed banknotes to the total number of dispensed banknotes. The overall qualified rate of dispensed banknotes mainly reflects an overall performance and quality of banknotes in the cashbox. The instant qualified rate of dispensed banknotes is used to evaluate a changing rate of instantaneous banknote dispensing performance of the cashbox over time. The instant qualified rate of dispensed banknotes evaluates instantaneous change of the banknote dispensing performance, which is mainly caused by partial banknote quality or a sudden change of a cashbox state. The instant qualified rate of dispensed banknotes may be approximated with a qualified rate of latest N (for example 30) dispensed banknotes. In addition, once a cashbox fails to continue working due to a banknote jam, or all banknotes in the cashbox are dispensed, an instant qualified rate of dispensed banknotes of the cashbox is zero. A high average qualified rate of dispensed banknotes indicates a high overall quality of the banknotes in the cashbox. A high instant qualified rate of dispensed banknotes indicates a high quality of partial banknotes, and fluctuations of the instant qualified rate of dispensed banknotes indicate instable quality of banknotes in the cashbox, for example new banknotes and old banknotes mixed together.

Suppose that eight of twenty banknotes dispensed from a cashbox are unqualified till a moment, totally 300 banknotes have been disposed in this banknotes-adding cycle, and 12 banknotes have entered the recycle box, then at this moment, the average qualified rate of dispensed banknotes is $$\frac{300-12}{300}\times 100\% = 96\%,$$

the instant qualified rate of dispensed banknotes is $$\frac{20-8}{20}\times 100\% = 60\%.$$

For simplicity in practice, the banknote dispensing quality may be evaluated only with the instant qualified rate of dispensed banknotes, or only with the average qualified rate of dispensed banknotes. The qualified rate of dispensed banknotes of a cashbox is calculated only if more than 10 banknotes are dispensed from the cashbox for a time, otherwise, a qualified rate of dispensed banknotes according to last service or set by the system is used, or a qualified rate of dispensed banknotes is calculated according to the latest 30 dispensed banknotes.

Step S4 includes: maintaining cashboxes ranked top M of the qualified rates of dispensed banknotes per nominal value in an open state, and maintaining the other cashboxes in a temporarily shielded state.

The temporarily shielded state indicates the cashbox is in a closed state and not in service in next banknote dispensing. In subsequent statistic for qualified rates of dispensed banknotes of the cashbox at every round of banknote dispensing, a qualified rate of dispensed banknotes of the temporarily shielded cashbox resulted from last time the cashbox actually dispensed banknotes is still used for the sequencing, and then the cashboxes ranked top M of the qualified rates of dispensed banknotes are opened, and rest cashboxes are temporarily shielded.

For example, suppose M=3, and qualified rates of dispensed banknotes and states of six cashboxes in the self-service terminal are:

| cashbox ID | qualified rate of dispensed banknotes | state |
|---|---|---|
| 05001 | 95% | open |
| 05002 | 90% | temporarily shielded |
| 05003 | 80% | temporarily shielded |
| 10004 | 93% | open |
| 10005 | 94% | open |
| 10006 | 0 | permanently shielded |

After a round of banknote dispensing is finished, qualified rates of dispensed banknotes and states of six cashboxes in the self-service terminal are:

| cashbox ID | qualified rate of dispensed banknotes | state |
|---|---|---|
| 05001 | 95% | open |
| 05002 | 90% | open |
| 05003 | 80% | open |
| 10004 | 0 | permanently shielded |
| 10005 | 72% | temporarily shielded |
| 10006 | 0 | permanently shielded |

After banknote dispensing is finished by the self-service terminal, banknote dispensing quality of each available cashbox is evaluated through the above steps, and re-sequenced. According to the new sequence, the self-service terminal opens cashboxes to dispense banknotes for next round of banknote dispensing.

The available cashbox indicates any cashbox with a qualified rate of dispensed banknotes larger than zero, no matter the cashbox is in a temporarily shielded state or in an open state. An unavailable cashbox indicates any cashbox having dispensed all banknotes or banknote-jammed, i.e., a cashbox with a qualified rate of dispensed banknotes is zero. The unavailable cashbox is no more used in this banknotes-adding cycle, unless maintenance personnel intervene in the maintenance and put the cashbox into use.

Figure 2:
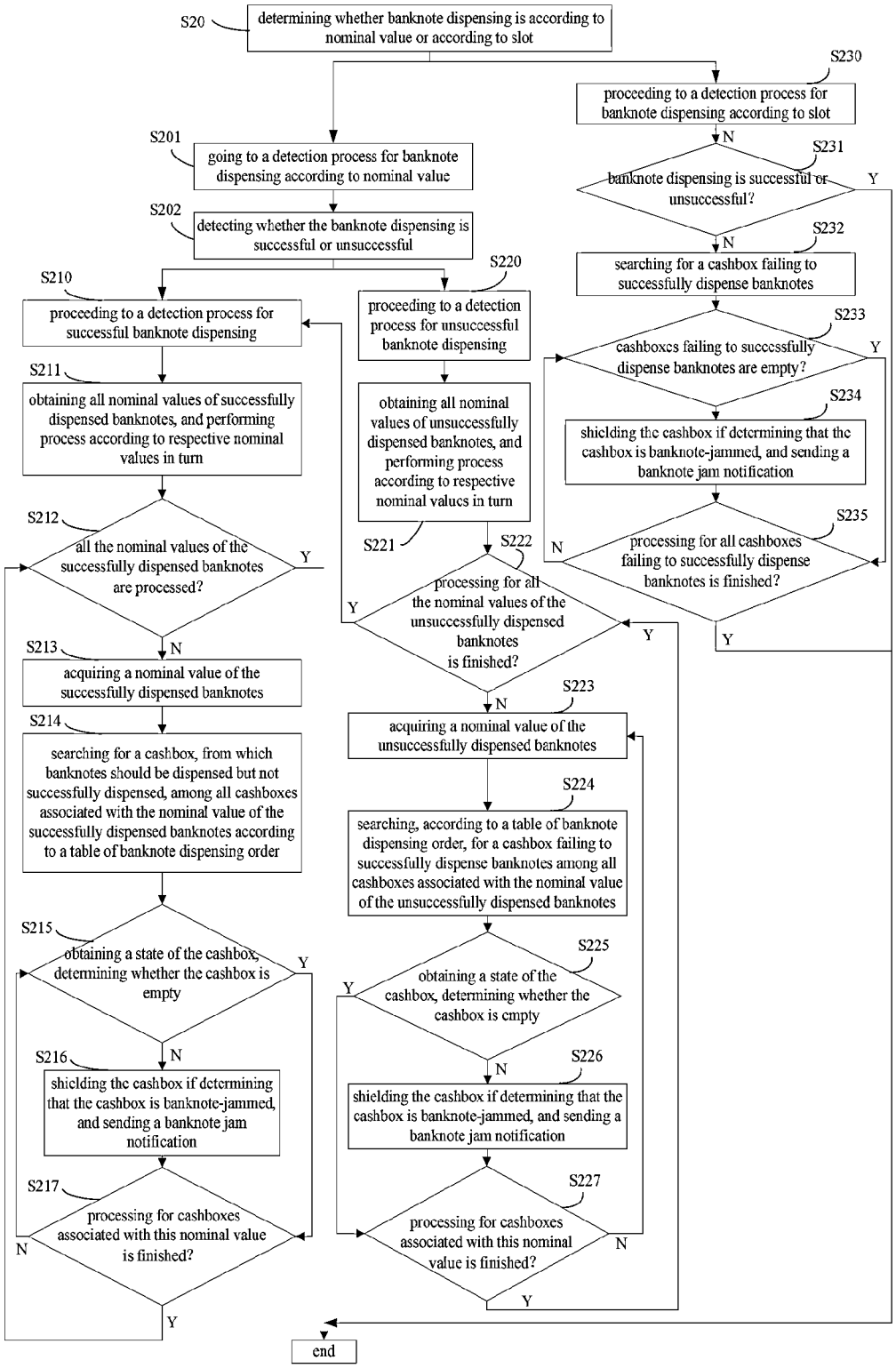
FIG. 2 is a flow chart of detecting a banknote-jammed cashbox in the self-service terminal in step 2 as shown in FIG. 1.

FIG. 2 is a flow chart of detecting a banknote-jammed cashbox in the self-service terminal in step 2 as shown in FIG. 1. In particular, the step 2 includes steps as follows.

Step S20 includes: determining whether banknote dispensing is according to nominal value or according to slot, before a dispenser performing the banknote dispensing action; proceeding to step S201 to perform a detection process for banknote dispensing according to nominal value, if the banknote dispensing is according to nominal value; or proceeding to step S230 to perform a detection process for banknote dispensing according to slot, if the banknote dispensing is according to slot.

Step S201 includes: proceeding to a detection process for banknote dispensing according to nominal value. The process includes steps as follows.

Step S202 includes: detecting whether the banknote dispensing is successful or unsuccessful; proceeding to step S210 if the banknote dispensing is successful; or proceeding to step S220 if the banknote dispensing is unsuccessful.

As to banknote dispensing according to nominal value, successfully dispensing banknotes indicates successfully dispensing banknotes of an amount desired by a user. Multiple cashboxes are arranged in the self-service terminal. The dispenser dispenses banknotes according to an order set in a table of a banknote dispensing order. For example, a first cashbox accommodates banknotes at nominal value 100, a second cashbox accommodates banknotes at nominal value 100, a third cashbox accommodates banknotes at nominal value 50, and a fourth cashbox accommodates banknotes at nominal value 50, then a banknote dispensing order is: from the first cashbox, to the second cashbox, to the third cashbox and then to the fourth box. Cashboxes accommodating banknotes at a same nominal value dispense according to an order as: banknotes are dispensed from the second cashbox after all banknotes in the first cashbox are dispensed; and in case that the first cashbox is empty or banknote-jammed, banknotes are dispensed from the second cashbox instead. Therefore, respect to banknote dispensing according to nominal value, successful banknote dispensing may include a case that banknote dispensing is unsuccessful for some cashboxes but is accomplished from other cashboxes. Therefore, detecting whether any cashbox for dispensing banknotes is banknote-jammed is needed, even if the banknote dispensing is successful.

Unsuccessfully dispensing banknotes indicates unsuccessfully dispensing banknotes of an amount desired by a user. Banknote dispensing is unsuccessful as a whole once banknote dispensing from cashboxes associated with a nominal value is unsuccessful.

Therefore, it is needed to detecting whether any cashbox for dispensing banknotes is banknote-jammed is needed to find out banknote-jammed cashboxes, if the banknote dispensing is unsuccessful.

Step S210 includes: proceeding to a detection process for successful banknote dispensing.

Step S211 includes: obtaining all nominal values of successfully dispensed banknotes, and performing process according to respective nominal values in turn.

The dispenser records the nominal value and the number of the banknotes dispensed from each cashbox, therefore all nominal values of the successfully dispensed banknotes can be obtained by using the banknote dispensing record of the dispenser.

Step S212 includes: determining whether all the nominal values of the successfully dispensed banknotes are processed; proceeding to step S213 if no; or ending if yes.

Step S213 includes: acquiring a nominal value of the successfully dispensed banknotes.

Step S214 includes: searching for a cashbox, from which banknotes should be dispensed but not successfully dispensed, among all cashboxes associated with the nominal value of the successfully dispensed banknotes according to a table of banknote dispensing order. In particular, all the cashboxes associated with the nominal value of the successfully dispensed banknotes are searched and detected in turn according to the table of banknote dispensing order till a last cashbox participating in this round of banknote dispensing, and the cashbox, associated with the nominal value, failing to successfully dispense banknotes is found out.

The table of banknote dispensing order is arranged in a storage module of the dispenser. The dispenser dispenses banknotes according to a banknote dispensing order scheduled by the table of banknote dispensing order. Banknote dispensing from the last cashbox participating in this round of banknote dispensing is certainly successful, for the successful banknote dispensing associated with the nominal value relies on the successful banknote dispensing of the last cashbox. Whereas banknote dispensing from cashboxes before the last cashbox participating in this round of banknote dispensing might be unsuccessful. The unsuccessful banknote dispensing of a cashbox indicates that although this cashbox participates in this round of dispensing, the number of dispensed banknotes does not reach a given value, or actually no banknotes are dispensed from the cashbox.

As to banknote dispensing according to nominal value, only if all banknote in a cashbox has been dispensed, banknotes in next cashbox associated with the same nominal value are to be dispensed. Therefore, for multiple cashboxes associated with the same nominal value, any cashboxes before a cashbox successfully dispensing banknotes might be empty or banknote-jammed.

Step S215 includes: obtaining a state of the cashbox, determining whether the cashbox is empty; proceeding to step S216, if no; or proceeding to step S217, if yes.

Step S216 includes: shielding the cashbox if determining that the cashbox is banknote-jammed and sending a notification of banknote jam to a remote server to prompt that the cashbox needs to be maintained.

Step S217 includes: determining whether processing for cashboxes associated with this nominal value is finished; returning to step S215 to determine states of rest cashboxes, if no; or returning to step S212, if yes.

Step S220 includes: proceeding to a detection process for unsuccessful banknote dispensing.

Step S221 includes: obtaining all nominal values of unsuccessfully dispensed banknotes, and performing process according to respective nominal values in turn.

Step S222 includes: determining whether processing for all the nominal values of the unsuccessfully dispensed banknotes is finished; proceeding to step S223, if no; or proceeding to step S210 if yes to further detect cashboxes successfully dispensing banknotes. The reason is: for the banknote dispensing according to nominal value, if banknote dispensing associated with a nominal value is unsuccessful, banknote dispensing associated with previous nominal values might be successful. Therefore, detecting cashboxes successfully dispensing banknotes is needed.

Step S223 includes: acquiring a nominal value of the unsuccessfully dispensed banknotes.

Step S224 includes: searching, according to a table of banknote dispensing order, for a cashbox failing to successfully dispense banknotes among all cashboxes associated with the nominal value of the unsuccessfully dispensed banknotes. In particular, all the cashboxes associated with the nominal value of the unsuccessfully dispensed banknotes are searched and detected in turn according to the table of banknote dispensing order, and cashboxes associated with the nominal value failing to successfully dispense banknotes are found out.

The table of banknote dispensing order is arranged in a storage module of the dispenser. The dispenser dispenses banknotes according to a banknote dispensing order scheduled by the table of banknote dispensing order. The last cashbox associated with this nominal value certainly participates in this round of dispensing, and fails to successfully dispense banknotes or is empty, which results in the unsuccessful dispensing associated with this nominal value. Whereas banknote dispensing from cashboxes before the last cashbox participating in this round of banknote dispensing might be unsuccessful. The unsuccessful banknote dispensing of a cashbox indicates that although this cashbox participates in this round of dispensing, the number of dispensed banknotes does not reach a given value, or actually no banknotes are dispensed from the cashbox.

As to banknote dispensing according to nominal value, only if all banknote in a cashbox has been dispensed, banknotes in next cashbox associated with the same nominal value are to be dispensed. Therefore, for multiple cashboxes associated with the same nominal value, any cashboxes before a cashbox unsuccessfully dispensing banknotes might be empty or banknote-jammed.

Step S225 includes: obtaining a state of the cashbox, determining whether the cashbox is empty; proceeding to step S226, if no; or proceeding to step S227, if yes.

Step S226 includes: shielding the cashbox if determining that the cashbox is banknote-jammed, and sending a banknote jam notification to a remote server to prompt that the cashbox needs to be maintained.

Step S227 includes: determining whether processing for cashboxes associated with this nominal value is finished;

returning to step S225 to determine states of rest cashboxes, if no; or returning to step S222, if yes.

Step S230 includes: proceeding to a detection process for banknote dispensing according to slot. The process includes steps as follows.

Step S231 includes: detecting whether the banknote dispensing is successful or unsuccessful; ending the detection if the banknote dispensing is successful; or proceeding to step S232 if the banknote dispensing is unsuccessful.

Step S232 includes: searching for a cashbox failing to successfully dispense banknotes.

As to banknote dispensing according to slot, banknotes are dispensed simultaneously from multiple slots. The number of banknotes to be dispensed is allocated for respective slots. The allocated number of banknotes to be dispensed and the number of actually dispensed banknotes are both recorded in the dispenser. The number of actually dispensed banknotes is compared with the allocated number of banknotes to be dispensed, and if the two numbers are inconsistent, the cashbox is a cashbox failing to successfully dispense banknotes.

Step S233 includes: determining in turn whether the cashboxes failing to successfully dispense banknotes are empty; determining a cashbox is a normal cashbox if the cashbox is in an empty state, shielding the cashbox and sending an empty cashbox signal to a remote server, and then proceeding to step S235; or proceeding to step S234 if the cashbox is not in an empty state.

Step S234 includes: shielding the cashbox if determining that the cashbox is banknote-jammed, and sending a banknote jam notification to a remote server to prompt that the cashbox needs to be maintained.

Step S235 includes: determining whether processing for all cashboxes failing to successfully dispense banknotes is finished; returning to step S33 to continue processing if no; or ending the process if yes.

A result of determining whether the cashboxes are empty is obtained according to a signal from a mechanical device or a sensor arranged on the cashboxes for detecting an empty cashbox.

According to the method for detecting and controlling banknote dispensing quality of a self-service terminal in this disclosure, in a service process of one banknotes-adding cycle, the self-service terminal dispenses banknotes first from a cashbox having a high qualified rate of dispensed banknotes among all slots or cashboxes associated with a same nominal value, and the qualified rates of dispensed banknotes are re-sequenced every time after banknote dispensing. Thus, banknotes in the recycle box are ensured as few as possible for a same amount of services, a full state of the recycle box is reached as late as possible, to reduce a failure rate of cash services in the self-service terminal resulted from a full recycle box, and to reduce possibility of the self-service terminal being out of service. Cashboxes with good banknotes equipped in the self-service terminal device are used opportunely. Negative impacts caused by unqualified banknotes are reduced to a minimum as possible. Especially, banknote resources are optimized to reduce idling, and impacts on an operation rate of the self-service equipment are reduced to a minimum.

Figure 3:
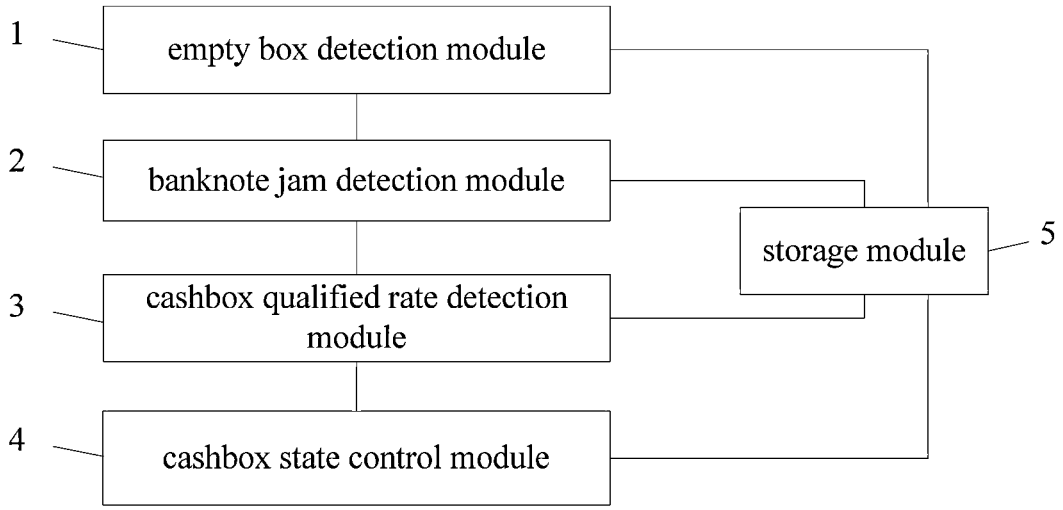
FIG. 3 is a modular diagram of a device for detecting and controlling banknote dispensing quality of a self-service terminal according to the disclosure.

In addition, a device for detecting and controlling banknote dispensing quality of a self-service terminal is further provided in the disclosure. FIG. 3 is a modular diagram of a device for detecting and controlling banknote dispensing quality of a self-service terminal according to the disclosure. The device for detecting and controlling banknote dispensing quality of a self-service terminal includes an empty box detection module 1, a banknote jam detection module 2, a cashbox qualified rate detection module 3, a cashbox state control module 4, and a storage module 5.

The empty box detection module 1 detects an empty box in the self-service terminal, sets a qualified rate of dispensed banknotes of the empty box as 0, and permanently shields the empty box. Banknote dispensing quality of the self-service terminal is evaluated with a qualified rate of dispensed banknotes, where the qualified rate of dispensed banknotes is a percentage of qualified banknotes to all banknotes dispensed from a cashbox after the banknotes being checked by a machine core. The empty box detection module 1 detects whether a cashbox is empty with a mechanical device or a sensor arranged in the cashbox, modifies the qualified rate of the cashbox, and may shield the cashbox. The permanently shielding indicates that the self-service terminal can not change the shielded state until maintenance personnel intervene. The detection for a permanently shielded cashbox may be omitted in next detection in a detection loop. After banknotes are put into the empty box, the shielded state can be modified into an open state manually.

The banknote jam detection module 2 detects a banknote-jammed cashbox in the self-service terminal, sets a qualified rate of dispensed banknotes of the banknote-jammed cashbox as 0, and permanently shields the banknote-jammed cashbox.

The cashbox qualified rate detection module 3 detects qualified rates of dispensed banknotes of all non-empty cashboxes and non-banknote-jammed cashboxes, and sequences all the non-empty cashboxes and non-banknote-jammed cashboxes.

The qualified rate of dispensed banknotes is a percentage of qualified banknotes to all banknotes dispensed from a cashbox after the banknotes being checked by a machine core. The qualified rate of dispensed banknotes includes two indexes, i.e., average qualified rate of dispensed banknotes, and instant qualified rate of dispensed banknotes. The average qualified rate of dispensed banknotes is evaluated with a percentage of the number of qualified dispensed banknotes to the total number of dispensed banknotes, after starting of a banknote dispensing cycle. The average qualified rate of dispensed banknotes is for evaluating, in a period or for a rated number of banknotes, a percentage of the number of qualified dispensed banknotes to the total number of dispensed banknotes. The overall qualified rate of dispensed banknotes mainly reflects an overall performance and quality of banknotes in the cashbox. The instant qualified rate of dispensed banknotes is used to evaluate a changing rate of instantaneous banknote dispensing performance of the cashbox over time. The instant qualified rate of dispensed banknotes evaluates instantaneous change of the banknote dispensing performance, which is mainly caused by partial banknote quality or a sudden change of a cashbox state. The instant qualified rate of dispensed banknotes may be approximated with a qualified rate of latest N (for example 30) dispensed banknotes. In addition, once a cashbox fails to continue working due to a banknote jam, or all banknotes in the cashbox are dispensed, an instant qualified rate of dispensed banknotes of the cashbox is zero. A high average qualified rate of dispensed banknotes indicates a high overall quality of the banknotes in the cashbox. A high instant qualified rate of dispensed banknotes indicates a high quality of partial banknotes, and fluctuations of the instant qualified rate of dispensed banknotes indicate instable quality of banknotes in the cashbox, for example new banknotes and old banknotes mixed together.

Suppose that eight of twenty banknotes dispensed from a cashbox are unqualified till a moment, totally 300 banknotes have been disposed in this banknotes-adding cycle, and 12 banknotes have entered the recycle box, then at this moment, the average qualified rate of dispensed banknotes is $$\frac{300-12}{300}\times 100\% = 96\%,$$

the instant qualified rate of dispensed banknotes is $$\frac{20-8}{20}\times 100\% = 60\%.$$

For simplicity in practice, the banknote dispensing quality may be evaluated only with the instant qualified rate of dispensed banknotes, or only with the average qualified rate of dispensed banknotes. The qualified rate of dispensed banknotes of a cashbox is calculated only if more than 10 banknotes are dispensed from the cashbox for a time, otherwise, a qualified rate of dispensed banknotes according to last service or set by the system is used, or a qualified rate of dispensed banknotes is calculated according to the latest 30 dispensed banknotes.

The cashbox state control module 4 maintains cashboxes ranked top M of the qualified rates of dispensed banknotes in an open state, and maintains the other cashboxes in a temporarily shielded state. The temporarily shielded state indicates the cashbox is in a closed state and not in service in this round of banknote dispensing. A qualified rate of dispensed banknotes of the temporarily shielded cashbox remains unchanged. Once there is a cashbox whose qualified rate of dispensed banknotes is lower than the qualified rate of dispensed banknotes of the temporarily shielded cashbox, top M cashboxes sequenced according to new qualified rates of dispensed banknotes are opened, and rest cashboxes are temporarily shielded.

The storage module 5 stores the detected qualified rate of dispensed banknotes of each cashbox and the set parameters, for all the modules to call.

Figure 4:
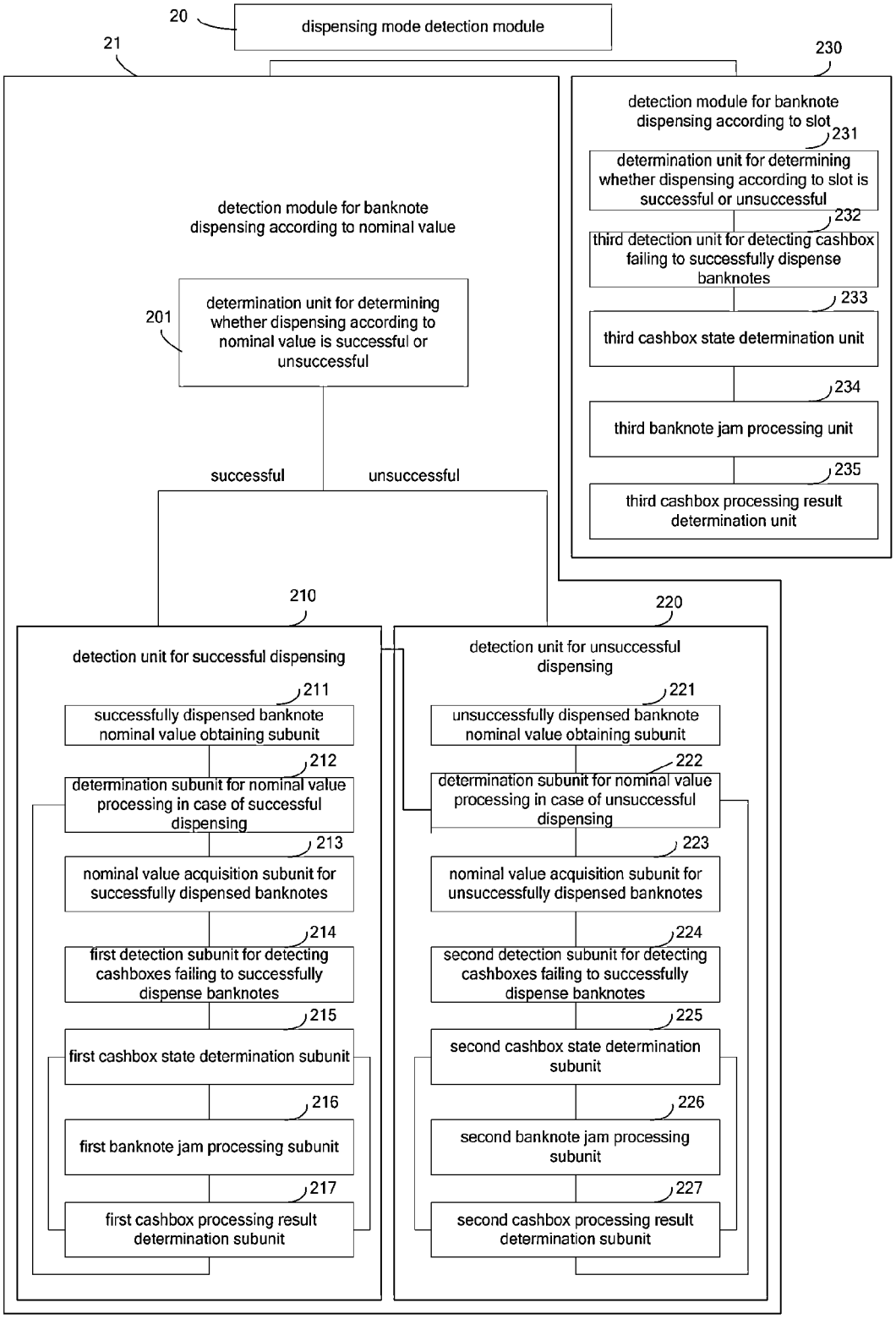
FIG. 4 is a modular diagram of a device for detecting banknote jam as shown in FIG. 3.

FIG. 4 is a modular diagram of the banknote jam detection module as shown in FIG. 3. The banknote jam detection module 2 includes a dispensing mode detection module 20, a detection module 21 for banknote dispensing according to nominal value, and a detection module 230 for banknote dispensing according to slot.

The dispensing mode detection module 20 determines whether banknote dispensing is according to nominal value or according to slot before a dispenser performing the banknote dispensing action; sends an instruction to control the detection module 21 for banknote dispensing according to nominal value to perform detection if the banknote dispensing is according to nominal value; or sends an instruction to control the detection module 230 for banknote dispensing according to slot to perform detection if the banknote dispensing is according to slot.

The detection module 21 for banknote dispensing according to nominal value includes a determination unit 201 for determining whether dispensing according to nominal value is successful or unsuccessful, a detection unit 210 for successful dispensing, and a detection unit 220 for unsuccessful dispensing. The determination unit 201 for determining whether dispensing according to nominal value is successful or unsuccessful detects whether the banknote dispensing is successful or unsuccessful, sends an instruction to the detection unit 210 for successful dispensing if the banknote dispensing is successful, or sends an instruction to the detection unit 220 for unsuccessful dispensing if the banknote dispensing is unsuccessful.

As to banknote dispensing according to nominal value, successfully dispensing banknotes indicates successfully dispensing banknotes of an amount desired by a user. Multiple cashboxes are arranged in the self-service terminal. The dispenser dispenses banknotes according to an order set in a table of a banknote dispensing order. For example, a first cashbox accommodates banknotes at nominal value 100, a second cashbox accommodates banknotes at nominal value 100, a third cashbox accommodates banknotes at nominal value 50, and a fourth cashbox accommodates banknotes at nominal value 50, then a banknote dispensing order is: from the first cashbox, to the second cashbox, to the third cashbox and then to the fourth box. Cashboxes accommodating banknotes at a same nominal value dispense according to an order as: banknotes are dispensed from the second cashbox after all banknotes in the first cashbox are dispensed; and in case that the first cashbox is empty or banknote-jammed, banknotes are dispensed from the second cashbox instead. Therefore, respect to banknote dispensing according to nominal value, successful banknote dispensing may include a case that banknote dispensing is unsuccessful for some cashboxes but is accomplished from other cashboxes. Therefore, detecting whether any cashbox for dispensing banknotes is banknote-jammed is needed, even if the banknote dispensing is successful.

Unsuccessfully dispensing banknotes indicates unsuccessfully dispensing banknotes of an amount desired by a user. Banknote dispensing is unsuccessful as a whole once banknote dispensing from cashboxes associated with a nominal value is unsuccessful. Therefore, it is needed to detecting whether any cashbox for dispensing banknotes is banknote-jammed is needed to find out banknote-jammed cashboxes, if the banknote dispensing is unsuccessful.

The detection unit 210 for successful dispensing controls to detect cashboxes failing to successfully dispense banknotes in a condition of successful banknote dispensing. The detection unit 210 for successful dispensing includes a successfully dispensed banknote nominal value obtaining subunit 211, a determination subunit 212 for nominal value processing in case of successful dispensing, a nominal value acquisition subunit 213 for successfully dispensed banknotes, a first detection subunit 214 for detecting cashboxes failing to successfully dispense banknotes, a first cashbox state determination subunit 215, a first banknote jam processing subunit 216, and a first cashbox processing result determination subunit 217.

The successfully dispensed banknote nominal value obtaining subunit 211 obtains all nominal values of successfully dispensed banknotes, and processes according to the nominal values one by one in turn. The dispenser records the nominal value and the number of the banknotes dispensed from each cashbox, therefore the successfully dispensed banknote nominal value obtaining subunit 211 can obtain all nominal values of the successfully dispensed banknotes by using the banknote dispensing record of the dispenser.

The determination subunit 212 for nominal value processing in case of successful dispensing determines whether all the nominal values of the successfully dispensed banknotes are processed; sends a message to the nominal value acquisition subunit 213 for successfully dispensed banknotes to continue processing if no; or ends the processing if yes.

The nominal value acquisition subunit 213 for successfully dispensed banknotes acquires a nominal value of the successfully dispensed banknotes, and then sends a message to the first detection subunit 214 for detecting cashboxes failing to successfully dispense banknotes.

The first detection subunit 214 for detecting cashboxes failing to successfully dispense banknotes searches for a cashbox associated with the nominal value, which fails to successfully dispense banknotes, among all cashboxes associated with the nominal value of the successfully dispensed banknotes, according to a table of banknote dispensing order A till a last cashbox participating in the banknote dispensing.

The table of banknote dispensing order A is arranged in a storage module of the dispenser. The dispenser dispenses banknotes according to a banknote dispensing order scheduled by the table of banknote dispensing order A. An example of the table of banknote dispensing order A is as follows.

| | | |
|---|---|---|
| BOX1 AB | | |
| BOX2 RB | loop | 100 |
| BOX3 RB | loop | 50 |
| BOX4 RB | dispensing banknotes | 100 |
| BOX5 RB | dispensing banknotes | 50 |

An order of banknote picking: BOX4---BOX2---BOX5---BOX3

Banknote dispensing from the last cashbox participating in this round of banknote dispensing is certainly successful, for the successful banknote dispensing associated with the nominal value relies on the successful banknote dispensing of the last cashbox. Whereas banknote dispensing from cashboxes before the last cashbox participating in this round of banknote dispensing might be unsuccessful. The unsuccessful banknote dispensing of a cashbox indicates that although this cashbox participates in this round of dispensing, the number of dispensed banknotes does not reach a given value, or actually no banknotes are dispensed from the cashbox.

As to banknote dispensing according to nominal value, only if all banknote in a cashbox has been dispensed, banknotes in next cashbox associated with the same nominal value are to be dispensed. Therefore, for multiple cashboxes associated with the same nominal value, any cashboxes before a cashbox successfully dispensing banknotes might be empty or banknote-jammed.

The first cashbox state determination subunit 215 obtains a state of the cashbox, determines whether the cashbox is empty; sends a message to the first banknote jam processing subunit 216, if no; or sends a message to the first cashbox processing result determination subunit, if yes.

The first banknote jam processing subunit 216 shields the cashbox if determining that the cashbox is banknote-jammed, sends a banknote jam notification to a remote server, to prompt that the cashbox needs to be maintained; and then sends a message to the first cashbox processing result determination subunit 217.

The first cashbox processing result determination subunit 217 determines whether processing for cashboxes associated with this nominal value is finished, sends a message to the first cashbox state determination subunit 215 if no, to continue determining states of rest cashboxes; or sends a message to the determination subunit 212 for nominal value processing in case of successful dispensing if yes, to determine whether processing for all the nominal values of successfully dispensed banknotes is finished.

The detection unit 220 for unsuccessful dispensing detects cashboxes in a condition of unsuccessful banknote dispensing. The detection unit 220 for unsuccessful dispensing includes an unsuccessfully dispensed banknote nominal value obtaining subunit 221, a determination subunit 222 for nominal value processing in case of unsuccessful dispensing, a nominal value acquisition subunit 223 for unsuccessfully dispensed banknotes, a second detection subunit 224 for detecting cashboxes failing to successfully dispense banknotes, a second cashbox state determination subunit 225, a second banknote jam processing subunit 226, and a second cashbox processing result determination subunit 227.

The unsuccessfully dispensed banknote nominal value obtaining subunit 221 obtains nominal values of unsuccessfully dispensed banknotes, and processes according to respective nominal values in turn.

The determination subunit 222 for nominal value processing in case of unsuccessful dispensing determines whether processing for all the nominal values of the unsuccessfully dispensed banknotes is finished; sends a message to the nominal value acquisition subunit 223 for unsuccessfully dispensed banknotes, if no; or sends a message to the detection unit 210 for successful dispensing if yes, to further detect cashboxes successfully dispensing banknotes. The reason is: for the banknote dispensing according to nominal value, if banknote dispensing associated with a nominal value is unsuccessful, banknote dispensing associated with previous nominal values might be successful. Therefore, detecting cashboxes successfully dispensing banknotes is needed.

The nominal value acquisition subunit 223 for unsuccessfully dispensed banknotes acquires a nominal value of the unsuccessfully dispensed banknotes, and then sends a message to the second detection subunit 224 for detecting cashboxes failing to successfully dispense banknotes.

The second detection subunit 224 for detecting cashboxes failing to successfully dispense banknotes searches, according to a table of banknote dispensing order, for a cashbox failing to successfully dispense banknotes among all cashboxes associated with the nominal value of the unsuccessfully dispensed banknotes. In particular, all the cashboxes associated with the nominal value of the unsuccessfully dispensed banknotes are searched and detected in turn according to the table of banknote dispensing order, and cashboxes associated with the nominal value failing to successfully dispense banknotes are found out. And then, a message is sent to the second cashbox state determination subunit 225.

The table of banknote dispensing order is arranged in a storage module of the dispenser. The dispenser dispenses banknotes according to a banknote dispensing order scheduled by the table of banknote dispensing order. The last cashbox associated with this nominal value certainly participates in this round of dispensing, and fails to successfully dispense banknotes or is empty, which results in the unsuccessful dispensing associated with this nominal value. Whereas banknote dispensing from cashboxes before the last cashbox participating in this round of banknote dispensing might be unsuccessful. The unsuccessful banknote dispensing of a cashbox indicates that although this cashbox participates in this round of dispensing, the number of dispensed banknotes does not reach a given value, or actually no banknotes are dispensed from the cashbox.

As to banknote dispensing according to nominal value, only if all banknote in a cashbox has been dispensed, banknotes in next cashbox associated with the same nominal value are to be dispensed. Therefore, for multiple cashboxes associated with the same nominal value, any cashboxes before a cashbox unsuccessfully dispensing banknotes might be empty or banknote-jammed.

The second cashbox state determination subunit 225 obtains a state of the cashbox, determines whether the cashbox is empty; sends a message to the second banknote jam processing subunit 226 to process, if no; or sends a message to the second cashbox processing result determination subunit 227 to process, if yes.

The second banknote jam processing subunit 226 shields the cashbox if determining that the cashbox is banknote-jammed, sends a banknote jam notification to a remote server to prompt that the cashbox needs to be maintained, and then sends a message to the second cashbox processing result determination subunit 227 to process.

The second cashbox processing result determination subunit 227 determines whether processing for cashboxes associated with this nominal value is finished; sends a message to the second cashbox state determination subunit 225 if no, to determine states of rest cashboxes; or sends a message to the determination subunit 222 for nominal value processing in case of unsuccessful dispensing to process.

The detection module 230 for banknote dispensing according to slot includes a determination unit 231 for determining whether dispensing according to slot is successful or unsuccessful, a third detection unit 232 for detecting cashbox failing to successfully dispense banknotes, a third cashbox state determination unit 233, a third banknote jam processing unit 234, and a third cashbox processing result determination unit 235. The determination unit 231 for determining whether dispensing according to slot is successful or unsuccessful detects whether the banknote dispensing is successful or unsuccessful; ends the detection if the banknote dispensing is successful; or sends an instruction to the third detection unit 232 for detecting cashbox failing to successfully dispense banknotes if the banknote dispensing is unsuccessful. The third detection unit 232 for detecting cashbox failing to successfully dispense banknotes searches for cashboxes failing to successfully dispense banknotes, and sends an instruction to the third cashbox state determination unit 233. The third cashbox state determination unit 233 determines in turn whether a cashbox failing to successfully dispense banknotes is empty; if the cashbox is in an empty state, determines that the cashbox is a normal cashbox, shields the cashbox, sends an empty cashbox signal to a remote server, and then sends an instruction to the third cashbox processing result determination unit 235; or sends an instruction to the third banknote jam processing unit 234 if the cashbox is not in an empty state. The third banknote jam processing unit 234 determines that the cashbox is banknote-jammed, shields the cashbox, sends a banknote jam notification to a remote server to prompt that the cashbox needs to be maintained, and then sends an instruction to the third cashbox processing result determination unit 235. The third cashbox processing result determination unit 235 determines whether processing for cashboxes associated with this nominal value is finished; sends an instruction to the third cashbox state determination unit 233 to continue processing, if no; or ends the process, if yes.

As to banknote dispensing according to slot, banknotes are dispensed simultaneously from multiple slots. The number of banknotes to be dispensed is allocated for respective slots. The allocated number of banknotes to be dispensed and the number of actually dispensed banknotes are both recorded in the dispenser. The number of actually dispensed banknotes is compared with the allocated number of banknotes to be dispensed, and if the two numbers are inconsistent, the cashbox is a cashbox failing to successfully dispense banknotes.

Compared with conventional technology, according to the device for detecting and controlling banknote dispensing quality of a self-service terminal in this disclosure, in a service process of one banknotes-adding cycle, the self-service terminal dispenses banknotes first from a cashbox having a high qualified rate of dispensed banknotes among all slots or cashboxes associated with a same nominal value, and the qualified rates of dispensed banknotes are re-sequenced every time after banknote dispensing. Thus, banknotes in the recycle box are ensured as few as possible for a same amount of services, a full state of the recycle box is reached as late as possible, to reduce a failure rate of cash services in the self-service terminal resulted from a full recycle box, and to reduce possibility of the self-service terminal being out of service. Cashboxes with good banknotes equipped in the self-service terminal device are used opportunely. Negative impacts caused by unqualified banknotes are reduced to a minimum as possible. Especially, banknote resources are optimized to reduce idling, and impacts on an operation rate of the self-service equipment are reduced to a minimum.

The disclosure is not limited to the foregoing embodiments. Any modification or transformation, which does not depart from the spirit and scope of the disclosure or falls in the scope of the claims of the disclosure or the equivalent thereof, is intended to be covered by the disclosure.

The invention claimed is:

1. A method for detecting and controlling banknote dispensing quality of a self-service terminal, comprising:

Step S1: detecting an empty cashbox in the self-service terminal, setting a qualified rate of dispensed banknotes of the empty cashbox as 0, and permanently shielding the empty cashbox;

Step S2: detecting a banknote-jammed cashbox in the self-service terminal, setting a qualified rate of dispensed banknotes of the banknote-jammed cashbox as 0, and permanently shielding the banknote-jammed cashbox;

Step S3: detecting qualified rates of dispensed banknotes of all non-empty cashboxes and non-banknote-jammed cashboxes, classifying all the non-empty and non-banknote-jammed cashboxes according to nominal values, and sequencing the cashboxes per nominal value in a descending order of the qualified rates of dispensed banknotes; and Step S4: maintaining cashboxes ranked top M of the qualified rates of dispensed banknotes per nominal value in an open state, and maintaining the other cashboxes in a temporarily shielded state.

2. The method for detecting and controlling banknote dispensing quality of a self-service terminal according to claim 1, wherein the qualified rate of dispensed banknotes in the step S3 is an average qualified rate of dispensed banknotes which is calculated from starting of a banknote dispensing cycle as a percentage of the number of qualified dispensed banknotes to the total number of dispensed banknotes, or the qualified rate of dispensed banknotes is an instant qualified rate of dispensed banknotes which is calculated for a predetermined number of dispensed banknotes as a percentage of the number of qualified dispensed banknotes to the predetermined number of dispensed banknotes.

3. The method for detecting and controlling banknote dispensing quality of a self-service terminal according to claim 2, wherein the step S2 comprises:

step S20: determining whether banknote dispensing is according to nominal value or according to slot, proceeding to step S201 if the banknote dispensing is according to nominal value; or proceeding to step S230 if the banknote dispensing is according to slot;

step S201: proceeding to a detection process for banknote dispensing according to nominal value, comprising: detecting whether the banknote dispensing is successful or unsuccessful, proceeding to step S210 to perform a detection process for successful banknote dispensing if the banknote dispensing is successful, to search for cashboxes failing to successfully dispense banknotes, or proceeding to step S220 to start a detection process for unsuccessful banknote dispensing if the banknote dispensing is unsuccessful, to search for cashboxes failing to successfully dispense banknotes; and step S230: proceeding to a detection process for banknote dispensing according to slot, comprising: detecting whether the banknote dispensing is successful or unsuccessful, ending the detection if the banknote dispensing is successful; or searching for a cashbox failing to successfully dispense banknotes if the banknote dispensing is unsuccessful.

4. The method for detecting and controlling banknote dispensing quality of a self-service terminal according to claim 3, wherein the detection process for successful banknote dispensing comprises:

step S211: obtaining all nominal values of successfully dispensed banknotes, and performing process according to respective nominal values in turn;

step S212: determining whether all the nominal values of the successfully dispensed banknotes are processed, proceeding to step S213 if no, or ending if yes;

step S213: acquiring a nominal value of the successfully dispensed banknotes;

step S214: searching for a cashbox, from which banknotes should be dispensed but not successfully dispensed, among all cashboxes associated with the nominal value of the successfully dispensed banknotes according to a table of banknote dispensing order;

step S215: obtaining a state of the cashbox, determining whether the cashbox is empty, proceeding to step S216 if no, or proceeding to step S217 if yes;

step S216: shielding the cashbox if determining that the cashbox is banknote-jammed; and step S217: determining whether processing for cashboxes associated with this nominal value is finished; returning to step S215 to determine states of remaining cashboxes if no, or returning to step S212 if yes.

5. The method for detecting and controlling banknote dispensing quality of a self-service terminal according to claim 4, wherein the step S214 further comprises: searching for all cashboxes associated with the nominal value acquired in step 3 according to the table of banknote dispensing order, detecting among all the cashboxes in turn according to the table of banknote dispensing order until a last cashbox participating in this round of banknote dispensing, and finding out the cashbox associated with the nominal value failing to successfully dispense banknotes.

6. The method for detecting and controlling banknote dispensing quality of a self-service terminal according to claim 5, wherein the detection process for unsuccessful banknote dispensing comprises:

step S221: obtaining nominal values of unsuccessfully dispensed banknotes, and processing according to the nominal values in turn;

step S222: determining whether processing for all the nominal values of the unsuccessfully dispensed banknotes is finished, proceeding to step S223 if no, or proceeding to step S210 if yes, to further detect cashboxes successfully dispensing banknotes;

step S224: searching for a cashbox failing to successfully dispense banknotes among all cashboxes associated with the nominal value of the unsuccessfully dispensed banknotes according to a table of banknote dispensing order;

step S225: obtaining a state of the cashbox, determining whether the cashbox is empty, proceeding to step S226 if no, or proceeding to step S227 if yes;

step S226: shielding the cashbox if determining that the cashbox is banknote-jammed; and step S227: determining whether processing for cashboxes associated with this nominal value is finished, returning to step S225 to continue determining states of remaining cashboxes if no, or returning to step S222 if yes.

7. The method for detecting and controlling banknote dispensing quality of a self-service terminal according to claim 6, wherein the detection process for banknote dispensing according to slot comprises:

step S231: detecting whether the banknote dispensing is successful or unsuccessful, ending the detection if the banknote dispensing is successful, or proceeding to step S232 if the banknote dispensing is unsuccessful;

step S232: searching for a cashbox failing to successfully dispense banknotes;

step S233: determining in turn whether the cashboxes failing to successfully dispense banknotes are empty, determining a cashbox is a normal cashbox and proceeding to step S235 if the cashbox is in an empty state, or proceeding to step S234 if the cashbox is not in an empty state, wherein the normal cashbox is empty and failing to successfully dispense banknotes;

step S234: shielding the cashbox if determining that the cashbox is banknote-jammed, and proceeding to step S235; and step S235: determining whether processing for all cashboxes failing to successfully dispense banknotes is finished, returning to step S233 if no, or ending if yes.

8. The method for detecting and controlling banknote dispensing quality of a self-service terminal according to claim 5, wherein the detection process for banknote dispensing according to slot comprises:

step S231: detecting whether the banknote dispensing is successful or unsuccessful, ending the detection if the banknote dispensing is successful, or proceeding to step S232 if the banknote dispensing is unsuccessful;

step S232: searching for a cashbox failing to successfully dispense banknotes;

step S233: determining in turn whether the cashboxes failing to successfully dispense banknotes are empty, determining a cashbox is a normal cashbox and proceeding to step S235 if the cashbox is in an empty state, or proceeding to step S234 if the cashbox is not in an empty state wherein the normal cashbox is empty and failing to successfully dispense banknotes;

step S234: shielding the cashbox if determining that the cashbox is banknote-jammed, and proceeding to step S235; and step S235: determining whether processing for all cashboxes failing to successfully dispense banknotes is finished, returning to step S233 if no, or ending if yes.

9. A device for detecting and controlling banknote dispensing quality of a self-service terminal, comprising:

a empty cashbox detection module, adapted to detect an empty cashbox in the self-service terminal, to set a qualified rate of dispensed banknotes of the empty cashbox as 0, and to permanently shield the empty cashbox;

a banknote jam detection module, adapted to detect a banknote-jammed cashbox in the self-service terminal, to set a qualified rate of dispensed banknotes of the banknote-jammed cashbox as 0, and to permanently shield the banknote-jammed cashbox;

a cashbox qualified rate detection module, adapted to detect qualified rates of dispensed banknotes of all non-empty cashboxes and non-banknote-jammed cashboxes, and to sequence all the non-empty cashboxes and non-banknote-jammed cashboxes;

a cashbox state control module, adapted to maintain cashboxes ranked top M of the qualified rates of dispensed banknotes in an open state, and to maintain the other cashboxes in a temporarily shielded state; and a storage module, adapted to store the qualified rate of dispensed banknotes of each cashbox detected each time and parameters for all other modules comprised in the self-service terminal to call.

10. The device for detecting and controlling banknote dispensing quality of a self-service terminal according to claim 9, wherein the banknote jam detection module comprises:

a dispensing mode detection module, adapted to determine whether banknote dispensing is according to nominal value or according to slot, to send an instruction to a detection module for banknote dispensing according to nominal value to perform detection if the dispensing is according to nominal value, or to send an instruction to a detection module for banknote dispensing according to slot to perform detection if the dispensing is according to slot;

the detection module for banknote dispensing according to nominal value, adapted to perform a detection process for banknote dispensing according to nominal value, comprising a determination unit for determining whether dispensing according to nominal value is successful or unsuccessful, a detection unit for successful dispensing, and a detection unit for unsuccessful dispensing, wherein the determination unit for determining whether dispensing according to nominal value is successful or unsuccessful detects whether the banknote dispensing is successful or unsuccessful, a detection process for successful banknote dispensing is performed by the detection unit for successful dispensing if the banknote dispensing is successful, to search for cashboxes failing to successfully dispense banknotes, or a detection process for unsuccessful banknote dispensing is performed by the detection unit for unsuccessful dispensing if the banknote dispensing is unsuccessful, to search for cashboxes failing to successfully dispense banknotes; and a detection module for banknote dispensing according to slot, adapted to perform a detection process for banknote dispensing according to slot, comprising a determination unit for determining whether dispensing according to slot is successful or unsuccessful, and a third detection unit for detecting cashboxes failing to successfully dispense banknotes, wherein the determination unit for determining whether dispensing according to slot is successful or unsuccessful determines whether banknote dispensing is successful or unsuccessful, ends the detection if the banknote dispensing is successful, or sends an instruction to the third cashbox detection unit for detecting cashboxes failing to successfully dispense banknotes if the banknote dispensing is unsuccessful, to search for cashboxes failing to successfully dispense banknotes.

11. The device for detecting and controlling banknote dispensing quality of a self-service terminal according to claim 10, wherein the detection unit for successful dispensing further comprises:

a successfully dispensed banknote nominal value obtaining subunit, adapted to obtain all nominal values of successfully dispensed banknotes, wherein the all nominal values of successfully dispensed banknotes are obtained according to respective nominal values in turn;

a determination subunit for nominal value processing in case of successful dispensing, adapted to determine whether all the nominal values of the successfully dispensed banknotes are processed, to send a message to a nominal value acquisition subunit for successfully dispensed banknotes if no to continue processing; or to end the processing if yes;

the nominal value acquisition subunit for successfully dispensed banknotes, adapted to acquire a nominal value of the successfully dispensed banknotes, and to send an instruction to a first detection subunit for detecting cashboxes failing to successfully dispense banknotes;

the first detection subunit for detecting cashboxes failing to successfully dispense banknotes, adapted to search for a cashbox, from which banknotes should be dispensed but not successfully dispensed, among all cashboxes associated with the nominal value of the successfully dispensed banknotes according to a table of banknote dispensing order;

a first cashbox state determination subunit, adapted to obtain a state of the cashbox and determine whether the cashbox is empty, to send an instruction to a first banknote jam processing subunit if no, or to send an instruction to a first cashbox processing result determination subunit if yes, the first banknote jam processing subunit, adapted to shield the cashbox and to send a message to the first cashbox processing result determination subunit, if determining that the cashbox is banknote-jammed; and the first cashbox processing result determination subunit, adapted to determine whether processing for cashboxes associated with this nominal value is finished, to send an instruction to the first cashbox state determination subunit if no to continue determining states of remaining cashboxes, or to send an instruction to the determination subunit for nominal value processing in case of successful dispensing if yes to determine whether processing for all the nominal values of successfully dispensed banknotes is finished.

12. The device for detecting and controlling banknote dispensing quality of a self-service terminal according to claim 11, wherein the first detection subunit for detecting cashboxes failing to successfully dispense banknotes is adapted to search for all cashboxes associated with the single nominal value acquired by the nominal value acquisition subunit for successfully dispensed banknotes, according to a table of banknote dispensing order, to detect among all cashboxes in turn according to the table of banknote dispensing order until a last cashbox participating in the banknote dispensing, and to find out the cashbox associated with the nominal value failing to successfully dispense banknotes.

13. The device for detecting and controlling banknote dispensing quality of a self-service terminal according to claim 12, wherein the detection unit for unsuccessful dispensing comprises:

an unsuccessfully dispensed banknote nominal value obtaining subunit, adapted to obtain nominal values of unsuccessfully dispensed banknotes, and to process according to respective nominal values in turn;

a determination subunit for nominal value processing in case of unsuccessful dispensing, adapted to determine whether processing for all the nominal values of the unsuccessfully dispensed banknotes is finished, to send an instruction to a nominal value acquisition subunit for unsuccessfully dispensed banknotes if no, or to send an instruction to the detection unit for successful dispensing if yes to further detect cashboxes successfully dispensing banknotes;

the nominal value acquisition subunit for unsuccessfully dispensed banknotes, adapted to acquire a nominal value of the unsuccessfully dispensed banknotes, and to send an instruction to a second detection subunit for detecting cashboxes failing to successfully dispense banknotes;

the second detection subunit for detecting cashboxes failing to successfully dispense banknotes, adapted to search, according to a table of banknote dispensing order, for a cashbox failing to successfully dispense banknotes among all cashboxes associated with the nominal value of the unsuccessfully dispensed banknotes, and then to send a message to a second cashbox state determination subunit;

the second cashbox state determination subunit, adapted to obtain a state of the cashbox and determine whether the cashbox is empty, to send an instruction to a second banknote jam processing subunit to process if no, or to send an instruction to a second cashbox processing result determination subunit to process if yes;

the second banknote jam processing subunit, adapted to shield the cashbox if determining that the cashbox is banknote-jammed, to send a message to the second cashbox processing result determination subunit to process; and the second cashbox processing result determination subunit, adapted to determine whether processing for cashboxes associated with this nominal value is finished; to send a message to the second cashbox state determination subunit if no to determine states of remaining cashboxes, or to send a message to the determination subunit for nominal value processing in case of unsuccessful dispensing to process.

14. The device for detecting and controlling banknote dispensing quality of a self-service terminal according to claim 13, wherein the detection module for banknote dispensing according to slot comprises a third cashbox state determination unit, a third banknote jam processing unit, and a third cashbox processing result determination unit, wherein the third detection unit for detecting cashbox failing to successfully dispense banknotes is adapted to search for cashboxes failing to successfully dispense banknotes, and to send an instruction to the third cashbox state determination unit; the third cashbox state determination unit is adapted to determine in turn whether a cashbox failing to successfully dispense banknotes is empty, to determine that the cashbox is a normal cashbox, shield the cashbox and send an instruction to the third cashbox processing result determination unit if the cashbox is in an empty state, or to send an instruction to the third banknote jam processing unit if the cashbox is not in an empty state; the third banknote jam processing unit is adapted to determine that the cashbox is banknote-jammed, shield the cashbox and send an instruction to the third cashbox processing result determination unit; the third cashbox processing result determination unit is adapted to determine whether processing for cashboxes associated with this nominal value is finished, to send an instruction to the third cashbox state determination unit if no, or to end up if yes, wherein the normal cashbox is empty and failing to successfully dispense banknotes.

15. The device for detecting and controlling banknote dispensing quality of a self-service terminal according to claim 9, further comprising a detection unit for successful dispensing, wherein the detection unit for successful dispensing further comprises:

a successfully dispensed banknote nominal value obtaining subunit, adapted to obtain all nominal values of successfully dispensed banknotes, wherein the all nominal values of successfully dispensed banknotes are obtained according to respective nominal values in turn;

a determination subunit for nominal value processing in case of successful dispensing, adapted to determine whether all the nominal values of the successfully dispensed banknotes are processed, to send a message to a nominal value acquisition subunit for successfully dispensed banknotes if no to continue processing; or to end the processing if yes;

the nominal value acquisition subunit for successfully dispensed banknotes, adapted to acquire a nominal value of the successfully dispensed banknotes, and to send an instruction to a first detection subunit for detecting cashboxes failing to successfully dispense banknotes;

the first detection subunit for detecting cashboxes failing to successfully dispense banknotes, adapted to search for a cashbox, from which banknotes should be dispensed but not successfully dispensed, among all cashboxes associated with the nominal value of the successfully dispensed banknotes according to a table of banknote dispensing order;

a first cashbox state determination subunit, adapted to obtain a state of the cashbox and determine whether the cashbox is empty, to send an instruction to a first banknote jam processing subunit if no, or to send an instruction to a first cashbox processing result determination subunit if yes, the first banknote jam processing subunit, adapted to shield the cashbox and to send a message to the first cashbox processing result determination subunit, if determining that the cashbox is banknote-jammed; and the first cashbox processing result determination subunit, adapted to determine whether processing for cashboxes associated with this nominal value is finished, to send an instruction to the first cashbox state determination subunit if no to continue determining states of remaining cashboxes, or to send an instruction to the determination subunit for nominal value processing in case of successful dispensing if yes to determine whether processing for all the nominal values of successfully dispensed banknotes is finished.

16. The device for detecting and controlling banknote dispensing quality of a self-service terminal according to claim 15, wherein the first detection subunit for detecting cashboxes failing to successfully dispense banknotes is adapted to search for all cashboxes associated with the single nominal value acquired by the nominal value acquisition subunit for successfully dispensed banknotes, according to a table of banknote dispensing order, to detect among all cashboxes in turn according to the table of banknote dispensing order until a last cashbox participating in the banknote dispensing, and to find out the cashbox associated with the nominal value failing to successfully dispense banknotes.

17. The device for detecting and controlling banknote dispensing quality of a self-service terminal according to claim 16, further comprising a detection unit for unsuccessful dispensing, wherein the detection unit for unsuccessful dispensing comprises:

an unsuccessfully dispensed banknote nominal value obtaining subunit, adapted to obtain nominal values of unsuccessfully dispensed banknotes, and to process according to respective nominal values in turn;

a determination subunit for nominal value processing in case of unsuccessful dispensing, adapted to determine whether processing for all the nominal values of the unsuccessfully dispensed banknotes is finished, to send an instruction to a nominal value acquisition subunit for unsuccessfully dispensed banknotes if no, or to send an instruction to the detection unit for successful dispensing if yes to further detect cashboxes successfully dispensing banknotes;

the nominal value acquisition subunit for unsuccessfully dispensed banknotes, adapted to acquire a nominal value of the unsuccessfully dispensed banknotes, and to send an instruction to a second detection subunit for detecting cashboxes failing to successfully dispense banknotes;

the second detection subunit for detecting cashboxes failing to successfully dispense banknotes, adapted to search, according to a table of banknote dispensing order, for a cashbox failing to successfully dispense banknotes among all cashboxes associated with the nominal value of the unsuccessfully dispensed banknotes, and then to send a message to a second cashbox state determination subunit;

the second cashbox state determination subunit, adapted to obtain a state of the cashbox and determine whether the cashbox is empty, to send an instruction to a second banknote jam processing subunit to process if no, or to send an instruction to a second cashbox processing result determination subunit to process if yes;

the second banknote jam processing subunit, adapted to shield the cashbox if determining that the cashbox is banknote-jammed, to send a message to the second cashbox processing result determination subunit to process; and the second cashbox processing result determination subunit, adapted to determine whether processing for cashboxes associated with this nominal value is finished; to send a message to the second cashbox state determination subunit if no to determine states of remaining cashboxes, or to send a message to the determination subunit for nominal value processing in case of unsuccessful dispensing to process.

18. The device for detecting and controlling banknote dispensing quality of a self-service terminal according to claim 17, further comprising a detection module for banknote dispensing according to slot, wherein the detection module for banknote dispensing according to slot comprises a third cashbox state determination unit, a third banknote jam processing unit, and a third cashbox processing result determination unit, wherein the third detection unit for detecting cashbox failing to successfully dispense banknotes is adapted to search for cashboxes failing to successfully dispense banknotes, and to send an instruction to the third cashbox state determination unit; the third cashbox state determination unit is adapted to determine in turn whether a cashbox failing to successfully dispense banknotes is empty, to determine that the cashbox is a normal cashbox, shield the cashbox and send an instruction to the third cashbox processing result determination unit if the cashbox is in an empty state, or to send an instruction to the third banknote jam processing unit if the cashbox is not in an empty state; the third banknote jam processing unit is adapted to determine that the cashbox is banknote-jammed, shield the cashbox and send an instruction to the third cashbox processing result determination unit; the third cashbox processing result determination unit is adapted to determine whether processing for cashboxes associated with this nominal value is finished, to send an instruction to the third cashbox state determination unit if no, or to end up if yes, wherein the normal cashbox is empty and failing to successfully dispense banknotes.

* * * * *